US009009037B2

(12) United States Patent
Yamanashi et al.

(10) Patent No.: US 9,009,037 B2
(45) Date of Patent: Apr. 14, 2015

(54) ENCODING DEVICE, DECODING DEVICE, AND METHODS THEREFOR

(75) Inventors: Tomofumi Yamanashi, Kanagawa (JP); Toshiyuki Morii, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 315 days.

(21) Appl. No.: 13/501,389

(22) PCT Filed: Oct. 13, 2010

(86) PCT No.: PCT/JP2010/006087

§ 371 (c)(1),
(2), (4) Date: Jun. 15, 2012

(87) PCT Pub. No.: WO2011/045926

PCT Pub. Date: Apr. 21, 2011

(65) Prior Publication Data

US 2012/0245931 A1 Sep. 27, 2012

(30) Foreign Application Priority Data

Oct. 14, 2009 (JP) ..... 2009-237683

(51) Int. Cl.
*G10L 19/00* (2013.01)
*G10L 21/00* (2013.01)
(Continued)

(52) U.S. Cl.
CPC ..... *G10L 19/24* (2013.01); *G10L 19/0212* (2013.01); *G10L 19/0204* (2013.01)

(58) Field of Classification Search
None
See application file for complete search history.

(56) References Cited

U.S. PATENT DOCUMENTS 6,446,037 B1 * 9/2002 Fielder et al. ..... 704/229
7,835,904 B2 * 11/2010 Li et al. ..... 704/200.1
(Continued)

FOREIGN PATENT DOCUMENTS

JP 2008-519991 6/2008
WO 2007/105586 9/2007
WO 2008/000408 * 2/2008

OTHER PUBLICATIONS

Akio Kami et al., "Scalable Audio Coding Based on Hierarchical Transform Coding Modules", Transaction of Institute of Electronics and Communication Engineers of Japan, A, vol. J83-A, No. 3, Mar. 2000, pp. 241-252, together with partial English translation.
(Continued)

*Primary Examiner* — Richemond Dorvil
*Assistant Examiner* — Thuykhanh Le
(74) *Attorney, Agent, or Firm* — Greenblum & Bernstein, P.L.C.

(57) ABSTRACT

Disclosed is an encoding device that improves the quality of a decoded signal in a hierarchical coding (scalable coding) method, wherein a band to be quantized is selected for every level (layer). The encoding device (101) is equipped with a second layer encoding unit (205) that selects a first band to be quantized of a first input signal from among a plurality of sub-bands, and that generates second layer encoding information containing first band information of said band; a second layer decoding unit (206) that generates a first decoded signal using the second layer encoding information; an addition unit (207) that generates a second input signal using the first input signal and the first decoded signal; and a third layer encoding unit (208) that selects a second band to be quantized of the second input signal using the first decoded signal, and that generates third layer encoding information.

5 Claims, 10 Drawing Sheets

(51) Int. Cl.
*G10L 19/24* (2013.01)
*G10L 19/02* (2013.01)

(56) References Cited

U.S. PATENT DOCUMENTS

| | | | | |
|---|---|---|---|---|
| 2005/0004794 | A1* | 1/2005 | Son et al. | 704/219 |
| 2005/0163323 | A1* | 7/2005 | Oshikiri | 381/22 |
| 2006/0036435 | A1* | 2/2006 | Kovesi et al. | 704/229 |
| 2006/0158356 | A1* | 7/2006 | Kim et al. | 341/51 |
| 2007/0016427 | A1* | 1/2007 | Thumpudi et al. | 704/500 |
| 2008/0255860 | A1* | 10/2008 | Osada | 704/503 |
| 2009/0070118 | A1 | 3/2009 | Den Brinker et al. | |
| 2009/0094024 | A1* | 4/2009 | Yamanashi et al. | 704/219 |
| 2009/0210219 | A1* | 8/2009 | Sung et al. | 704/203 |
| 2009/0234644 | A1* | 9/2009 | Reznik et al. | 704/203 |
| 2009/0240491 | A1* | 9/2009 | Reznik | 704/219 |
| 2009/0281811 | A1* | 11/2009 | Oshikiri et al. | 704/500 |
| 2010/0017204 | A1* | 1/2010 | Oshikiri et al. | 704/222 |
| 2010/0169081 | A1* | 7/2010 | Yamanashi et al. | 704/203 |
| 2010/0198587 | A1* | 8/2010 | Ramabadran et al. | 704/205 |
| 2011/0035227 | A1* | 2/2011 | Lee et al. | 704/500 |
| 2013/0325457 | A1* | 12/2013 | Oshikiri et al. | 704/222 |

OTHER PUBLICATIONS

Hiroyuki Ehara et al., "Development of 32kbit/s scalable wide-band speech and audio coding algorithm using high-efficiency code-excited linear prediction and band-selective modified discrete cosine transform coding algorithms", Journal of the Acoustical Society of Japan, vol. 64, No. 4, The Acoustical Society of Japan (ASJ), Apr. 1, 2008, pp. 196-207.

U.S. Appl. No. 13/501,354 to Tomofumi Yamanashi, filed Apr. 11, 2012.

U.S. Appl. No. 13/505,634 to Tomofumi Yamanashi et al., filed May 2, 2012.

* cited by examiner

ENCODING DEVICE, DECODING DEVICE, AND METHODS THEREFOR

TECHNICAL FIELD

The present invention relates to a coding apparatus, a decoding apparatus, and method thereof, which are used in a communication system that encodes and transmits a signal.

BACKGROUND ART

When a speech/audio signal is transmitted in a packet communication system typified by Internet communication, a mobile communication system, or the like, compression/encoding technology is often used in order to increase speech/audio signal transmission efficiency. Also, recently, there is a growing need for technologies of simply encoding speech/audio signals at a low bit rate and encoding speech/audio signals of a wider band.

Various technologies of integrating plural coding technologies in a hierarchical manner have been developed for the needs. For example, Non-Patent Literature 1 disclosed a technique of encoding a spectrum (MDCT (Modified Discrete Cosine Transform) coefficient) of a desired frequency band in the hierarchical manner using TwinVQ (Transform Domain Weighted Interleave Vector Quantization) in which a basic constituting unit is modularized. Simple scalable encoding having a high degree of freedom can be implemented by common use of the module plural times. In the technique, a sub-band that becomes a coding target of each hierarchy (layer) is basically a predetermined configuration. At the same time, there is also disclosed a configuration in which a position of the sub-band that becomes the coding target of each hierarchy (layer) is varied in a predetermined band according to a characteristic of an input signal.

CITATION LIST

Non-Patent Literature

NPTL 1

Akio Kami et al., "Scalable Audio Coding Based on Hierarchical Transform Coding Modules", Transaction of Institute of Electronics and Communication Engineers of Japan, A, Vol. J83-A, No. 3, pp. 241-252, March, 2000

SUMMARY OF INVENTION

Technical Problem

However, in Non-Patent Literature 1, the position of the sub-band that becomes the quantization target is previously fixed in each hierarchy (layer), and a coding result (quantized band) in a lower hierarchy that is previously encoded is not utilized. Therefore, unfortunately a coding accuracy is not enhanced too much in consideration of the whole hierarchies. Additionally, a candidate of the position of the sub-band that becomes the quantization target in each hierarchy is restricted to not the whole band but a predetermined band, and the sub-band having large residual energy is not possibly selected as the quantization target in a certain hierarchy (layer). As a result, unfortunately the quality of the generated decoded speech becomes insufficient.

The object of the present invention is to provide a coding apparatus, a decoding apparatus, and method thereof being able to improve the quality of the decoded signal in the hierarchical encoding (scalable encoding) scheme in which the band of the quantization target is selected in each hierarchy (layer).

Solution to Problem

A coding apparatus of the present invention that includes at least two coding layers includes: a first layer coding section that inputs a first input signal of a frequency domain thereto, selects a first quantization target band of the first input signal from a plurality of sub-bands into which the frequency domain is divided, encodes the first input signal of the first quantization target band to generate first coded information including first band information on the first quantization target band, generates a first decoded signal using the first coded information, and generates a second input signal using the first input signal and the first decoded signal; and a second layer coding section that inputs the second input signal and the first decoded signal or the first coded information thereto, selects a second quantization target band of the second input signal from the plurality of sub-bands using the first decoded signal or the first coded information, encodes the second input signal of the second quantization target band, and generates second coded information including second band information on the second quantization target band.

A decoding apparatus of the present invention that receives and decodes information generated by a coding apparatus including at least two coding layers includes: a receiving section that receives the information including first coded information and second coded information, the first coded information being obtained by encoding a first layer of the coding apparatus, the first coded information including first band information generated by selecting a first quantization target band of the first layer from a plurality of sub-bands into which a frequency domain is divided, the second coded information being obtained by encoding a second layer of the coding apparatus using a first layer decoded signal that is generated using the first coded information, the second coded information including second band information generated by selecting a second quantization target band of the second layer from the plurality of sub-bands; a first layer decoding section that inputs the first coded information obtained from the information thereto, and generates a first decoded signal with respect to the first quantization target band set based on the first band information included in the first coded information; and a second layer decoding section that inputs the second coded information obtained from the information, and generates a second decoded signal with respect to the second quantization target band set based on the second band information included in the second coded information.

A coding method of the present invention for performing encoding in at least two coding layers includes: a first layer encoding step of inputting a first input signal of a frequency domain thereto, selecting a first quantization target band of the first input signal from a plurality of sub-bands into which the frequency domain is divided, encoding the first input signal of the first quantization target band to generate first coded information including first band information on the first quantization target band, generating a first decoded signal using the first coded information, and generating a second input signal using the first input signal and the first decoded signal; and a second layer encoding step of inputting the second input signal and the first decoded signal or the first coded information thereto, selecting a second quantization target band of the second input signal from the plurality of sub-bands using the first decoded signal or the first coded information, encoding the second input signal of the second quantization target band, and generating second coded information including second band information on the second quantization target band.

A decoding method of the present invention for receiving and decoding information generated by a coding apparatus including at least two coding layers includes: a receiving step of receiving the information including first coded information and second coded information, the first coded information being obtained by encoding a first layer of the coding apparatus, the first coded information including first band information generated by selecting a first quantization target band of the first layer from a plurality of sub-bands into which a frequency domain is divided, the second coded information being obtained by encoding a second layer of the coding apparatus using a first layer decoded signal that is generated using the first coded information, the second coded information including second band information generated by selecting a second quantization target band of the second layer from the plurality of sub-bands; a first layer decoding step of inputting the first coded information obtained from the information thereto, and generating a first decoded signal with respect to the first quantization target band set based on the first band information included in the first coded information; and a second layer decoding step of inputting the second coded information obtained from the information, and generating a second decoded signal with respect to the second quantization target band set based on the second band information included in the second coded information.

Advantageous Effects of Invention

According to the invention, in the hierarchy coding scheme (scalable encoding) in which the band of the quantization target is selected in each hierarchy (layer), the perceptually important band can be encoded in each layer by selecting the quantization target band of the current layer based on the coding result (quantized band) of the lower layer, and therefore the quality of the decoded signal can be improved.

DESCRIPTION OF EMBODIMENTS

Figure 1:
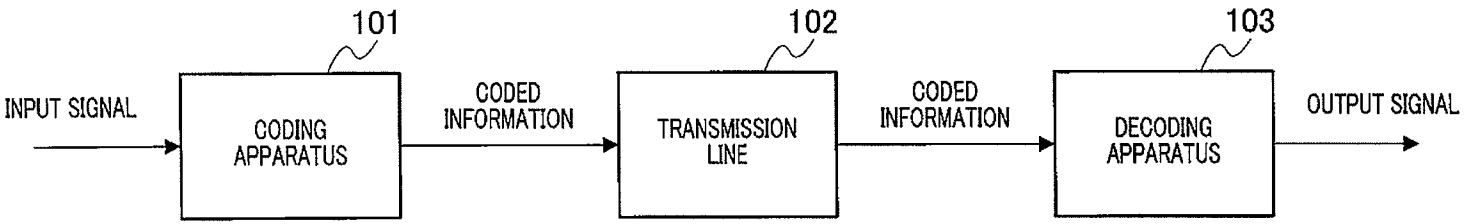
FIG. 1 is a block diagram illustrating a configuration of a communication system including a coding apparatus and a decoding apparatus according to Embodiment 1 of the invention.

Referring to the drawings, one embodiment of the present invention will be described in detail. A speech coding apparatus and a speech decoding apparatus are described as examples of the coding apparatus and decoding apparatus of the invention.

Embodiment 1

FIG. 1 is a block diagram illustrating a configuration of a communication system including a coding apparatus and a decoding apparatus according to Embodiment 1 of the invention. In FIG. 1, the communication system includes coding apparatus 101 and decoding apparatus 103, and coding apparatus 101 and decoding apparatus 103 can conduct communication with each other through transmission line 102. Herein, coding apparatus 101 and decoding apparatus 103 are usually mounted in a base station apparatus, a communication terminal apparatus, and the like for use.

Coding apparatus 101 divides an input signal into respective N samples (N is a natural number), and performs encoding in each frame with the N samples as one frame. At this point, it is assumed that x(n) is the input signal that becomes a coding target. n (n=0, . . . , N−1) expresses an (n+1)th signal element in the input signal that is divided every N samples. Coding apparatus 101 transmits encoded input information (hereinafter referred to as "coded information") to decoding apparatus 103 through transmission line 102.

Decoding apparatus 103 receives the coded information that is transmitted from coding apparatus 101 through transmission line 102, and decodes the coded information to obtain an output signal.

Figure 2:
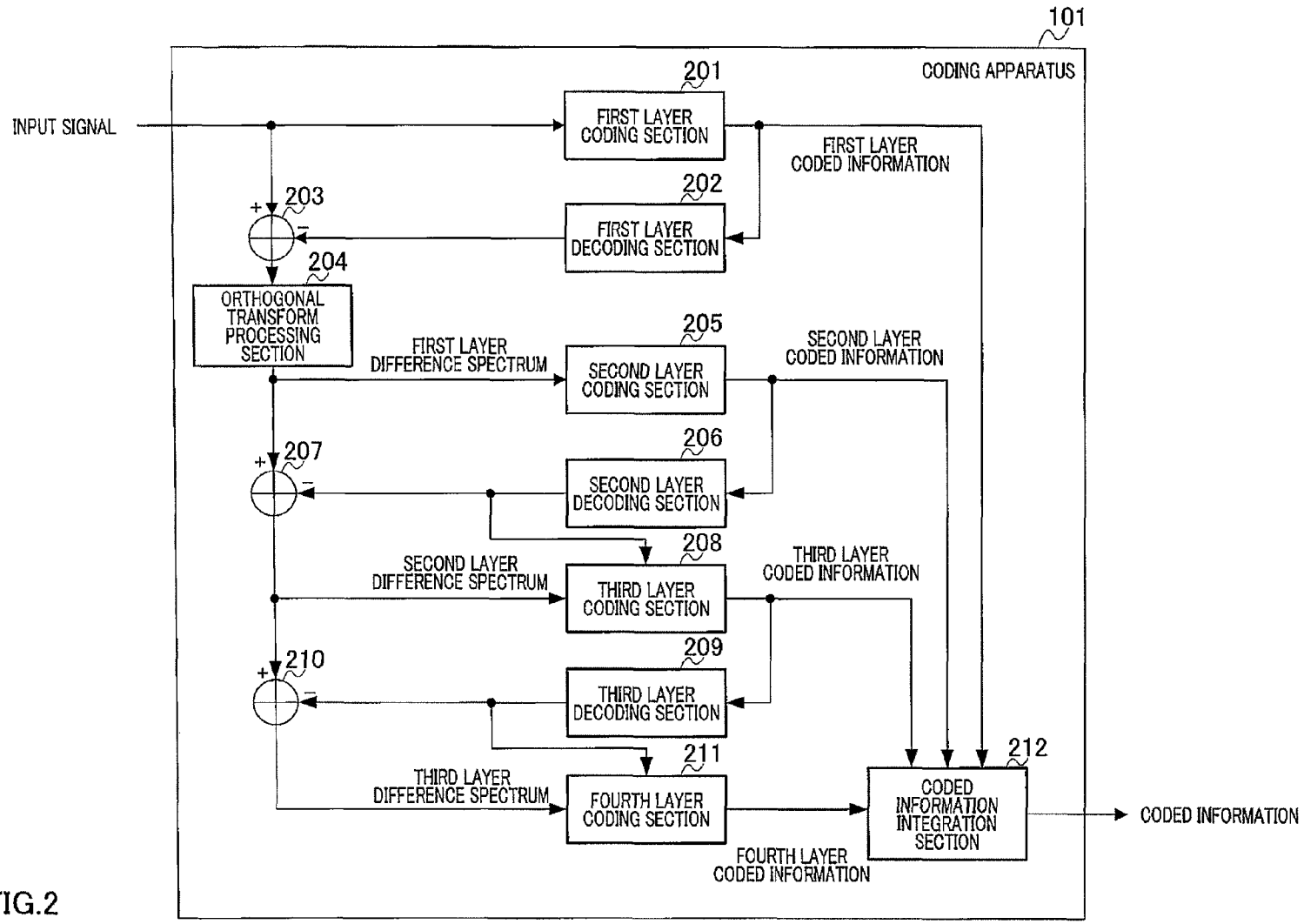
FIG. 2 is a block diagram illustrating a main configuration of the coding apparatus in FIG. 1.

FIG. 2 is a block diagram illustrating a main configuration of coding apparatus 101 in FIG. 1. For example, it is assumed that coding apparatus 101 is a hierarchical coding apparatus including four encoding hierarchies (layers). Hereinafter, it is assumed that the four layers are referred to as a first layer, a second layer, a third layer, and a fourth layer in the ascending order of a bit rate.

For example, first layer coding section 201 encodes the input signal by a CELP (Code Excited Linear Prediction) speech coding method to generate first layer coded information, and outputs the generated first layer coded information to first layer decoding section 202 and coded information integration section 212.

For example, first layer decoding section 202 decodes the first layer coded information, which is input from first layer coding section 201, by the CELP speech decoding method to generate a first layer decoded signal, and outputs the generated first layer decoded signal to adder 203.

Adder 203 adds the first layer decoded signal to the input signal while inverting a polarity of the first layer decoded signal, thereby calculating a difference signal between the input signal and the first layer decoded signal. Then, adder 203 outputs the obtained difference signal as a first layer difference signal to orthogonal transform processing section 204.

Orthogonal transform processing section 204 includes buffer buf1($n$)(n=0, . . . , N−1) therein, and converts first layer difference signal x1($n$) into a frequency domain parameter (frequency domain signal) by performing an MDCT (Modified Discrete Cosine Transform) to first layer difference signal x1($n$)

An orthogonal transform processing in orthogonal transform processing section 204, namely, an orthogonal transform processing calculating procedure and data output to an internal buffer will be described below.

Orthogonal transform processing section 204 initializes buffer buf1($n$) to an initial value "0" by the following equation (1).

[1]

$$buf1(n)=0(n=0, \ldots, N-1) \quad \text{(Equation 1)}$$

Then orthogonal transform processing section 204 performs the Modified Discrete Cosine Transform (MDCT) to the first layer difference signal x1($n$) according to the following equation (2), and obtains an MDCT coefficient (hereinafter referred to as a "first layer difference spectrum") X1($k$) of the first layer difference signal x1($n$).

[2]

$$X1(k) = \frac{2}{N}\sum_{n=0}^{2N-1} x1'(n)\cos\left[\frac{(2n+1+N)(2k+1)\pi}{4N}\right] \quad \text{(Equation 2)}$$

$$(k = 0, \ldots, N-1)$$

Where k is an index of each sample in one frame. Using the following equation (3), orthogonal transform processing section 204 obtains x1'(n) that is a vector formed by coupling the first layer difference signal x1($n$) and buffer buf1($n$).

[3]

$$x1'(n) = \begin{cases} buf1(n) & (n = 0, \cdots N-1) \\ x1(n-N) & (n = N, \cdots 2N-1) \end{cases} \quad \text{(Equation 3)}$$

Then, orthogonal transform processing section 204 updates buffer buf1($n$) using the following equation (4).

[4]

$$buf1(n)=x1(n)(n=0, \ldots, N-1) \quad \text{(Equation 4)}$$

Orthogonal transform processing section 204 outputs the first layer difference spectrum X1($k$) to second layer coding section 205 and adder 207.

Second layer coding section 205 generates second layer coded information using the first layer difference spectrum X1($k$) input from orthogonal transform processing section 204, and outputs the generated second layer coded information to second layer decoding section 206 and coded information integration section 212. The details of second layer coding section 205 will be described later.

Second layer decoding section 206 decodes the second layer coded information input from second layer coding section 205, and calculates a second layer decoded spectrum. Second layer decoding section 206 outputs the generated second layer decoded spectrum to adder 207 and third layer coding section 208. The details of second layer decoding section 206 will be described later.

Adder 207 adds the second layer decoded spectrum to the first layer difference spectrum while inverting the polarity of the second layer decoded spectrum, thereby calculating a difference spectrum between the first layer difference spectrum and the second layer decoded spectrum. Then, adder 207 outputs the obtained difference spectrum as a second layer difference spectrum to third layer coding section 208 and adder 210.

Third layer coding section 208 generates third layer coded information using the second layer decoded spectrum input from second layer decoding section 206 and the second layer difference spectrum input from adder 207, and outputs the generated third layer coded information to third layer decoding section 209 and coded information integration section 212. The details of third layer coding section 208 will be described later.

Third layer decoding section 209 decodes the third layer coded information input from third layer coding section 208, and calculates a third layer decoded spectrum. Third layer decoding section 209 outputs the generated third layer decoded spectrum to adder 210 and fourth layer coding section 211. The details of third layer decoding section 209 will be described later.

Adder 210 adds the third layer decoded spectrum to the second layer difference spectrum while inverting the polarity of the third layer decoded spectrum, thereby calculating a difference spectrum between the second layer difference spectrum and the third layer decoded spectrum. Then, adder 210 outputs the obtained difference spectrum as a third layer difference spectrum to fourth layer coding section 211.

Fourth layer coding section 211 generates fourth layer coded information using the third layer decoded spectrum input from third layer decoding section 209 and third layer difference spectrum input from adder 210, and outputs the generated fourth layer coded information to coded information integration section 212. The details of fourth layer coding section 211 will be described later.

Coded information integration section 212 integrates the first layer coded information input from first layer coding section 201, the second layer coded information input from second layer coding section 205, the third layer coded information input from third layer coding section 208, and the fourth layer coded information input from fourth layer coding section 211, and if necessary, coded information integration section 212 attaches a transmission error code and the like to the integrated information source code, and outputs the result to transmission line 102 as coded information.

Figure 3:
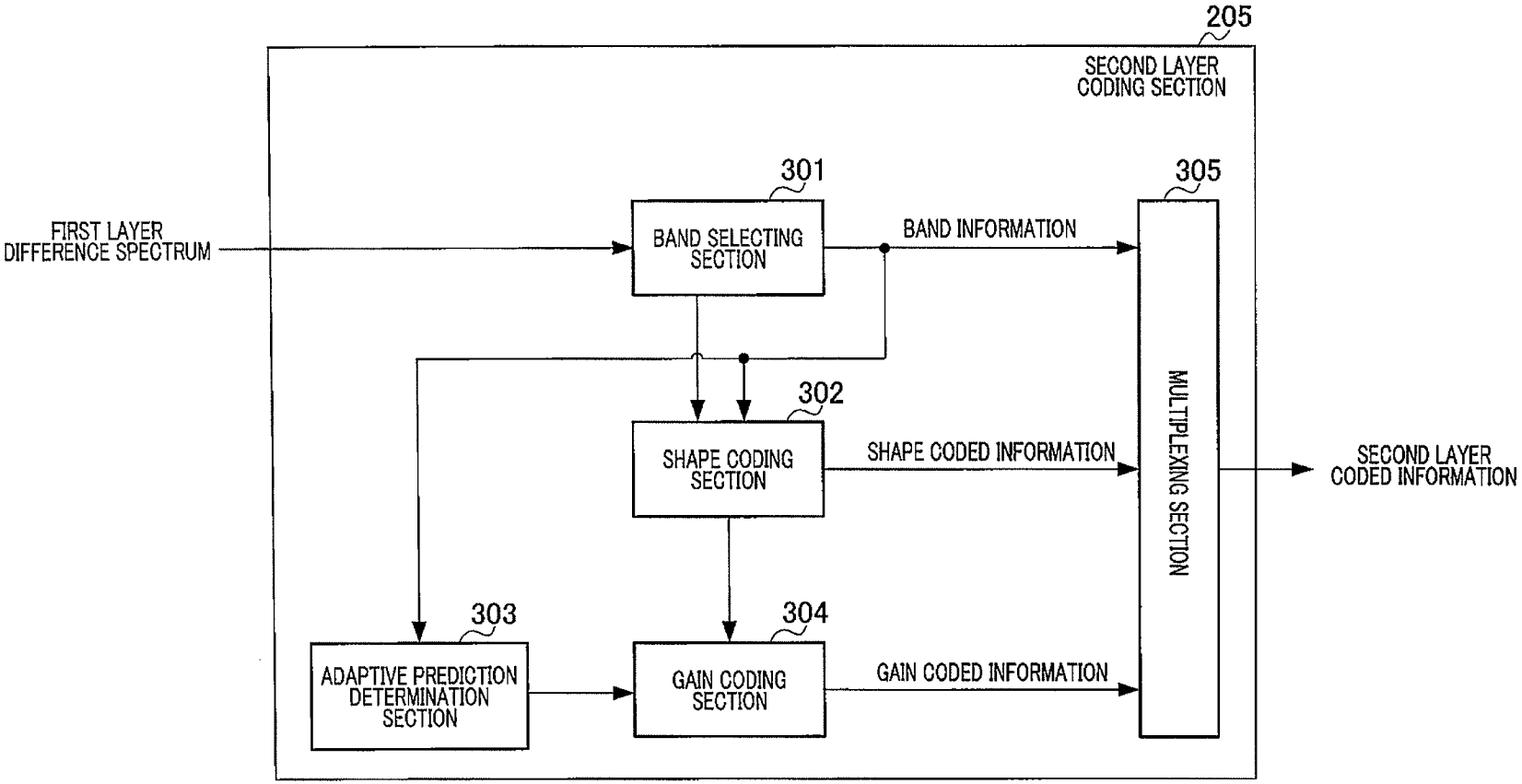
FIG. 3 is a block diagram illustrating a main configuration of a second layer coding section in FIG. 2.

FIG. 3 is a block diagram illustrating a main configuration of second layer coding section 205.

In FIG. 3, second layer coding section 205 includes band selecting section 301, shape coding section 302, adaptive prediction determination section 303, gain coding section 304, and multiplexing section 305.

Band selecting section 301 divides the first layer difference spectrum input from orthogonal transform processing section 204 into plural sub-bands, selects a band (quantization target band) that becomes a quantization target from the plural sub-bands, and outputs band information indicating the selected band to shape coding section 302, adaptive prediction determination section 303, and multiplexing section 305. Band selecting section 301 outputs the first layer difference spectrum to shape coding section 302. As to the input of the first layer difference spectrum to shape coding section 302, the first layer difference spectrum may directly be input from orthogonal transform processing section 204 to shape coding section 302 irrespective of the input of the first layer difference spectrum from orthogonal transform processing section 204 to band selecting section 301. The details of processing of band selecting section 301 will be described later.

Using the spectrum (MDCT coefficient) corresponding to the band indicated by the band information input from band selecting section 301 in the first layer difference spectrum input from band selecting section 301, shape coding section 302 encodes the shape information to generate shape coded information, and outputs the generated shape coded information to multiplexing section 305. Shape coding section 302 obtains an ideal gain (gain information) that is calculated during shape encoding, and outputs the obtained ideal gain to gain coding section 304. The details of processing of shape coding section 302 will be described later.

Adaptive prediction determination section 303 includes an internal buffer in which the input from band selecting section 301 in the past is stored. Adaptive prediction determination section 303 obtains the number of sub-bands common to both the quantization target band of the current frame and the quantization target band of the past frame using the band information input from band selecting section 301. Adaptive prediction determination section 303 determines that predictive coding is performed to the spectrum (MDCT coefficient) of the quantization target band indicated by the band information when the number of common sub-bands is more than a predetermined value. On the other hand, when the number of common sub-bands is less than the predetermined value, adaptive prediction determination section 303 determines that the predictive coding is not performed to the spectrum (MDCT coefficient) of the quantization target band indicated by the band information (that is, encoding to which prediction is not applied is performed). Adaptive prediction determination section 303 outputs the determination result to gain coding section 304. The details of processing of adaptive prediction determination section 303 will be described later.

The ideal gain from shape coding section 302 and the determination result from adaptive prediction determination section 303 are input to gain coding section 304. When the determination result input from adaptive prediction determination section 303 indicates that the predictive coding is performed, gain coding section 304 performs the predictive coding to the ideal gain, which is input from shape coding section 302, to obtain the gain coded information using a quantized gain value of the past frame stored in a built-in buffer, and a built-in gain code book. On the other hand, when the determination result input from adaptive prediction determination section 303 indicates that the predictive coding is not performed, gain coding section 304 directly quantizes the ideal gain input from shape coding section 302 (that is, quantizes the ideal gain without applying the prediction) to obtain the gain coded information. Gain coding section 304 outputs the obtained gain coded information to multiplexing section 305. The details of processing of gain coding section 304 will be described later.

Multiplexing section 305 multiplexes the band information input from band selecting section 301, the shape coded information input from shape coding section 302, and the gain coded information input from gain coding section 304, and outputs an obtained bit stream as the second layer coded information to second layer decoding section 206 and coded information integration section 212.

Second layer coding section 205 having the above configuration is operated as follows.

Figure 4:
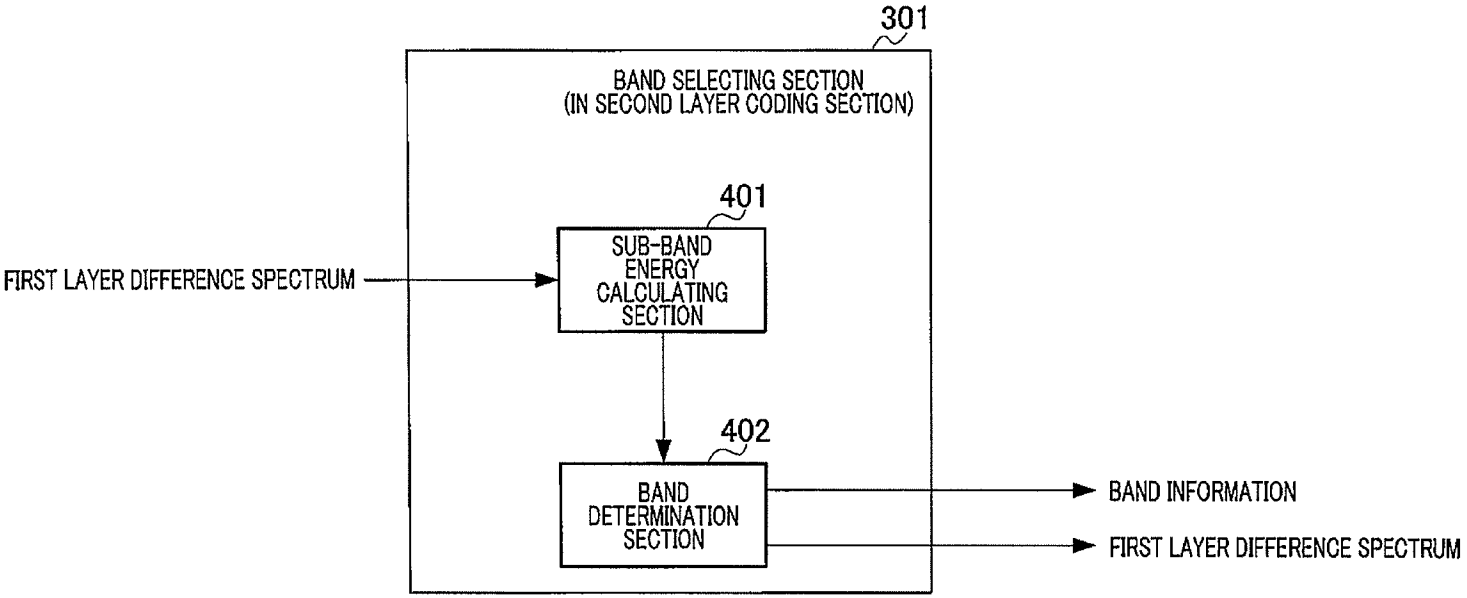
FIG. 4 is a block diagram illustrating a main configuration of a band selecting section in FIG. 3.

FIG. 4 is a block diagram illustrating a main configuration of band selecting section 301.

In FIG. 4, band selecting section 301 mainly includes sub-band energy calculating section 401 and band determination section 402.

The first layer difference spectrum X1($k$) is input to sub-band energy calculating section 401 from orthogonal transform processing section 204.

Sub-band energy calculating section 401 divides the first layer difference spectrum X1($k$) into the plural sub-bands. The case that the first layer difference spectrum X1($k$) is equally divided into J (J is a natural number) sub-bands will be described by way of example. Sub-band energy calculating section 401 selects consecutive L (L is a natural number) sub-bands in the J sub-bands to obtain M (M is a natural number) kinds of groups of the sub-bands. Hereinafter, the M kinds of groups of the sub-bands are referred to as a region.

Figure 5:
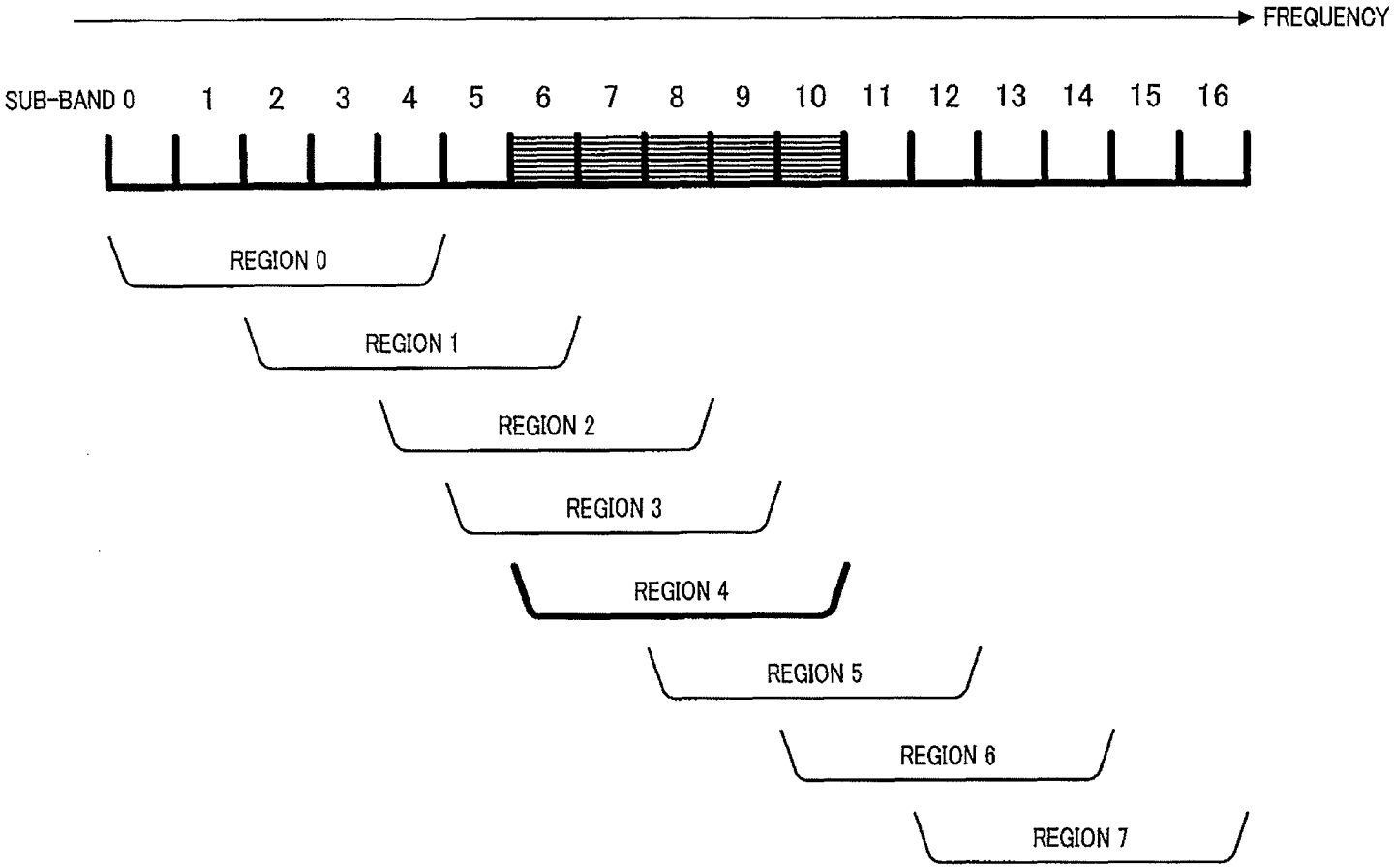
FIG. 5 is a view illustrating a configuration of a region according to Embodiment 1.

FIG. 5 is a view illustrating a configuration of a region obtained in sub-band energy calculating section 401.

In FIG. 5, the number of sub-bands is 17 (J=17), the number of kinds of the regions is 8 (M=8), and consecutive 5 (L=5) sub-bands constitute each region. For example, region 4 includes sub-bands 6 to 10.

Then, sub-band energy calculating section 401 calculates average energy E1($m$) in each of the M kinds of regions according to the following equation (5).

[5]

$$E1(m) = \frac{\sum_{j=S(m)}^{S(m)+L-1} \sum_{k=B(j)}^{B(j)+W(j)} (X1(k))^2}{L} \quad (m = 0, \cdots, M-1) \qquad \text{(Equation 5)}$$

Where j is an index of each of the J sub-bands and m is an index of each of the M kinds of regions. S(m) indicates a minimum value in indexes of the L sub-bands constituting region m, and B(j) is a minimum value in indexes of the plural MDCT coefficients constituting sub-band j. W(j) indicates a band width of sub-band j. The case that J sub-bands have the equal band width, namely, W(j) is a constant, will be described below by way of example. Sub-band energy calculating section 401 outputs the obtained average energy E1($m$) of each region to band determination section 402.

The average energy E1($m$) of each region is input to band determination section 402 from sub-band energy calculating section 401. Band determination section 402 selects the region where the average energy E1($m$) is maximized, for example, the band including sub-bands j" to (j"+L−1) as a band (quantization target band) that becomes the quantization target, and band determination section 402 outputs an index m_max indicating the region as the band information to shape coding section 302, adaptive prediction determination section 303, and multiplexing section 305. Band determination section 402 outputs the first layer difference spectrum X1($k$) of the quantization target band to shape coding section 302. The first layer difference spectrum input to band selecting section 301 may directly be input to band determination section 402, or the first layer difference spectrum may be input through sub-band energy calculating section 401. Hereinafter, it is assumed that j" to (j"+L−1) are band indexes indicating the quantization target band selected by band determination section 402.

Shape coding section 302 performs shape quantization in each sub-band to the first layer difference spectrum X1($k$) corresponding to the band that is indicated by band information m_max input from band selecting section 301. Specifically, shape coding section 302 searches a built-in shape code book including SQ shape code vectors in each of the L sub-bands, and obtains the index of the shape code vector in which an evaluation scale Shape(k) of the following equation (6) is maximized.

[6]

$$\text{Shape_q}(i) = \frac{\left\{\sum_{k=0}^{W(j)} (X1(k+B(j)) \cdot SC_k^i)\right\}^2}{\sum_{k=0}^{W(j)} SC_k^i \cdot SC_k^i} \quad \text{(Equation 6)}$$

$$(j = j'', \cdots, j'' + L - 1,\ i = 0, \cdots, SQ - 1)$$

Where $SC^i_k$ is the shape code vector constituting the shape code book, i is the index of the shape code vector, and k is the index of the element of the shape code vector.

Shape coding section 302 outputs an index S_max of the shape code vector, in which the result of the equation (6) is maximized, as the shape coded information to multiplexing section 305. Shape coding section 302 calculates an ideal gain Gain_i(j) according to the following equation (7), and outputs the calculated ideal gain Gain_i(j) to gain coding section 304.

[7]

$$\text{Gain_i}(j) = \frac{\sum_{k=0}^{W(j)} \left(X1(k+B(j)) \cdot SC_k^{S_max}\right)}{\sum_{k=0}^{W(j)} SC_k^{S_max} \cdot SC_k^{S_max}} \quad \text{(Equation 7)}$$

$$(j = j'', \cdots, j'' + L - 1)$$

Adaptive prediction determination section 303 is provided with a buffer in which the band information m_max input from band selecting section 301 in the past frame is stored. The case that adaptive prediction determination section 303 is provided with the buffer in which the pieces of band information m_max for the past three frames are stored will be described by way of example. Adaptive prediction determination section 303 obtains the number of sub-bands common to both between the quantization target band of the past frame and the quantization target band of the current frame using the band information m_max input from band selecting section 301 in the past frame and the band information m_max input from band selecting section 301 in the current frame. Adaptive prediction determination section 303 determines that the predictive coding is performed when the number of common sub-bands is equal to or more than the predetermined value, and adaptive prediction determination section 303 determines that the predictive coding is not performed when the number of common sub-bands is less than the predetermined value. Specifically, adaptive prediction determination section 303 compares the L sub-bands that are indicated by the band information m_max input from band selecting section 301 in one frame before the current frame in the past frame with the L sub-bands that are indicated by the band information m_max input from band selecting section 301 in the current frame. Adaptive prediction determination section 303 determines that the predictive coding is performed when the number of common sub-bands is equal to or more than P, and adaptive prediction determination section 303 determines that the predictive coding is not performed when the number of common sub-bands is less than P. Adaptive prediction determination section 303 outputs the determination result to gain coding section 304. Then, using the band information m_max input from band selecting section 301 in the current frame, adaptive prediction determination section 303 updates the built-in buffer in which the band information is stored.

Gain coding section 304 is provided with a buffer in which the quantized gain obtained in the past frame is stored. When the determination result input from the adaptive prediction determination section 303 indicates that the predictive coding is performed, gain coding section 304 predicts the gain value of the current frame to perform the quantization using quantized gain $C^t_j$ of the past frame stored in the built-in buffer. Specifically, gain coding section 304 searches the built-in gain code book including the GQ gain code vectors in each of the L sub-bands, and obtains the index of the gain code vector in which a square error Gain_q(i) of the following equation (8) is minimized.

[8]

$$\text{Gain_q}(i) = \left\{\sum_{j=0}^{L-1} \left\{\text{Gain_i}(j+j'') - \sum_{t=1}^{3} \left(\alpha_t - C^t_{j+j''}\right) - \alpha_0 \cdot GC^i_j\right\}\right\}^2 \quad \text{(Equation 8)}$$

$$(i = 0, \cdots, GQ - 1)$$

Where $GC^i_j$ is the gain code vector constituting the gain code book, i is the index of the gain code vector, and j is the index of the element of the gain code vector. For example, j has values of 0 to 4 in the case that the number of sub-bands constituting the region is 5 (in the case of L=5). At this point, $C^t_j$ indicates the gain of the frame in t frames before the current frame. For example, in the case of t=1, $C^t_j$ indicates the gain of the frame in one frame before the current frame. $\alpha 0$ to $\alpha 3$ are quartic linear prediction coefficients stored in gain coding section 304. Gain coding section 304 deals with the L sub-bands in one region as an L-dimensional vector to perform vector quantization.

Gain coding section 304 outputs an index G_min of the gain code vector, in which the result of the equation (8) is minimized, as the gain coded information to multiplexing section 305. In the case that the gain of the sub-band corresponding to the past frame in the built-in buffer does not exist, in the equation (8), gain coding section 304 substitutes the gain of the closest sub-band in terms of the frequency in the built-in buffer for the gain of the sub-band corresponding to the past frame in the built-in buffer.

On the other hand, when the determination result input from adaptive prediction determination section 303 indicates that the predictive coding is not performed, gain coding section 304 directly quantizes the ideal gain Gain_i(j) input from shape coding section 302 according to the following equation (9). Gain coding section 304 deals with the ideal gain as the L-dimensional vector to perform the vector quantization.

[9]

$$\text{Gain_q}(i) = \left\{\sum_{j=0}^{L-1} \{\text{Gain_i}(j+j'') - GC^i_j\}\right\}^2 \quad \text{(Equation 9)}$$

$$(i = 0, \cdots, GQ - 1)$$

Gain coding section 304 outputs an index G_min of the gain code vector, in which the result of the equation (9) is minimized, as the gain coded information to multiplexing section 305.

Gain coding section 304 updates the built-in buffer according to the following equation (10) using the gain coded information G_min and the quantized gain $C^t_j$, which are obtained in the current frame.

[10]

$$\begin{cases} C^3_{j+j''} = C^2_{j+j''} \\ C^2_{j+j''} = C^1_{j+j''} \quad (j = 0, \cdots, L-1) \\ C^1_{j+j''} = GC_j^{G_min} \end{cases} \quad \text{(Equation 10)}$$

Multiplexing section 305 multiplexes the band information m_max input from band selecting section 301, the shape coded information S_max input from shape coding section 302, and the gain coded information G_min input from gain coding section 304. Multiplexing section 305 outputs the bit stream obtained by the multiplexing as the second layer coded information to second layer decoding section 206 and coded information integration section 212.

Figure 6:
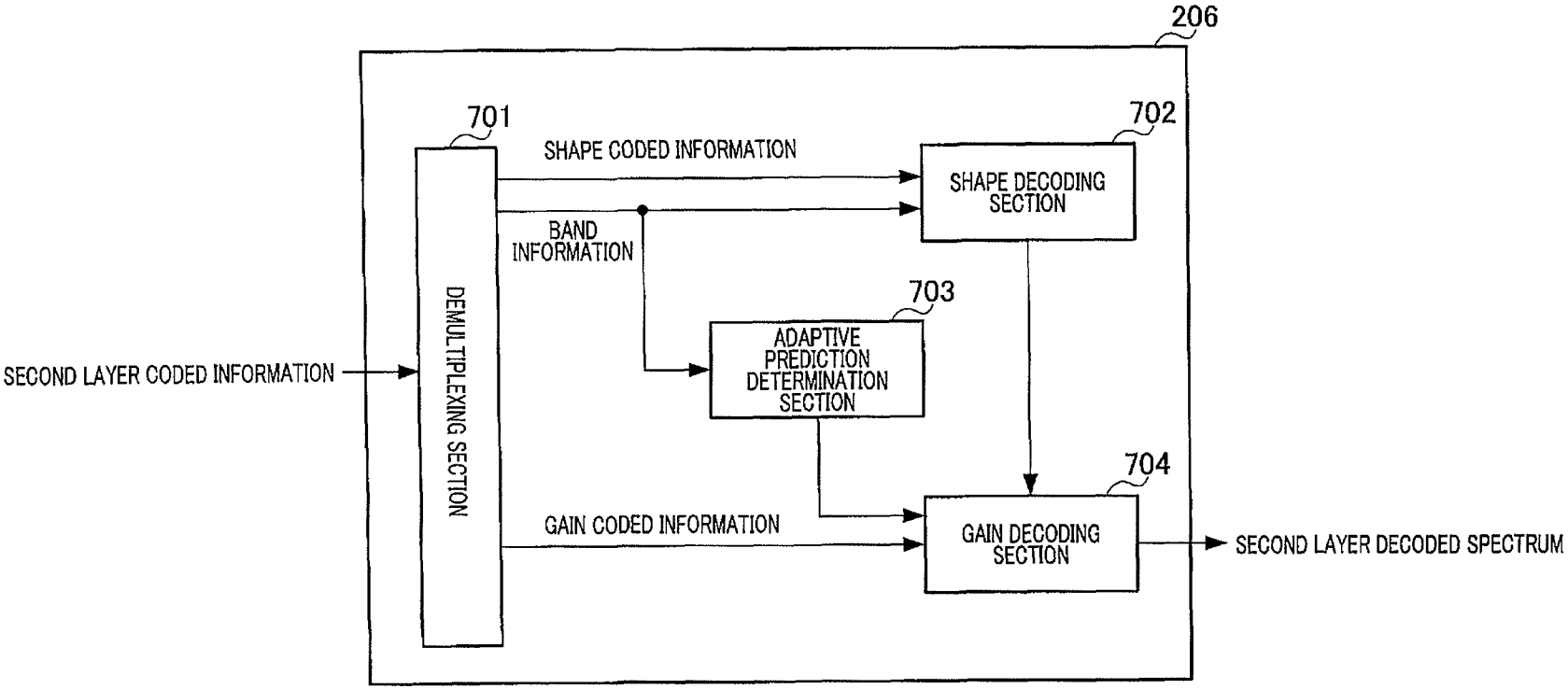
FIG. 6 is a block diagram illustrating a main configuration of a second layer decoding section in FIG. 2.

FIG. 6 is a block diagram illustrating a main configuration of second layer decoding section 206.

In FIG. 6, second layer decoding section 206 includes demultiplexing section 701, shape decoding section 702, adaptive prediction determination section 703, and gain decoding section 704.

Demultiplexing section 701 demultiplexes the band information, the shape coded information, and the gain coded information from the second layer coded information input from second layer coding section 205, outputs the obtained band information to shape decoding section 702 and adaptive prediction determination section 703, outputs the obtained shape coded information to shape decoding section 702, and outputs the obtained gain coded information to gain decoding section 704.

Shape decoding section 702 obtains the value of the shape of the MDCT coefficient corresponding to the quantization target band, which is indicated by the band information input from demultiplexing section 701, by decoding the shape coded information input from demultiplexing section 701, and shape decoding section 702 outputs the obtained value of the shape to gain decoding section 704. The details of processing of shape decoding section 702 will be described later.

Adaptive prediction determination section 703 obtains the number of sub-bands common to both the quantization target band of the current frame and the quantization target band of the past frame using the band information input from band selecting section 701. When the number of common sub-bands is equal to or more than a predetermined value, adaptive prediction determination section 703 determines that the prediction decoding is performed to the MDCT coefficient of the quantization target band indicated by the band information. When the number of common sub-bands is less than a predetermined value, adaptive prediction determination section 703 determines that the prediction decoding is not performed to the MDCT coefficient of the quantization target band indicated by the band information. Adaptive prediction determination section 703 outputs the determination result to gain decoding section 704. The details of processing of adaptive prediction determination section 703 will be described later.

When the determination result input from adaptive prediction determination section 703 indicates that the predictive decoding is performed, gain decoding section 704 performs the predictive decoding to the gain coded information, which is input from demultiplexing section 701, to obtain a gain value using the gain value of the past frame stored in the built-in buffer and the built-in gain code book. On the other hand, when the determination result input from adaptive prediction determination section 703 indicates that the predictive decoding is not performed, gain decoding section 704 obtains the gain value by directly performing dequantization to the gain coded information input from demultiplexing section 701 using the built-in gain code book. Gain decoding section 704 obtains a decoded MDCT coefficient of the quantization target band using the obtained gain value and the value of the shape input from shape decoding section 702, and outputs the obtained decoded MDCT coefficient as the second layer decoded spectrum to adder 207 and third layer coding section 208. The details of processing of gain decoding section 704 will be described later.

Second layer decoding section 206 having the above configuration is operated as follows.

Demultiplexing section 701 demultiplexes the band information m_max, the shape coded information S_max, and the gain coded information G_min from the second layer coded information input from second layer coding section 205. Demultiplexing section 701 outputs the obtained band information m_max to shape decoding section 702 and adaptive prediction determination section 703, outputs the obtained shape coded information S_max to shape decoding section 702, and outputs the obtained gain coded information G_min to gain decoding section 704.

Shape decoding section 702 is provided with the same shape code book as the shape code book included in shape coding section 302 of second layer coding section 205. Shape decoding section 702 searches the shape code vector in which the shape coded information S_max input from demultiplexing section 701 is used as the index. Shape decoding section 702 outputs the searched shape code vector as the value of the shape of the MDCT coefficient of the quantization target band, which is indicated by the band information m_max input from demultiplexing section 701, to gain decoding section 704. At this point, the shape code vector that is searched as the value of the shape is expressed by Shape_q(k) (k= B(j"), . . . , B(j"+L)−1).

Adaptive prediction determination section 703 is provided with a buffer in which the band information m_max input from band selecting section 701 in the past frame is stored. The case that adaptive prediction determination section 703 is provided with the buffer in which the pieces of band information m_max for the past three frames are stored will be described by way of example. Adaptive prediction determination section 703 obtains the number of sub-bands common to both the quantization target band of the past frame and the quantization target band of the current frame using the band information m_max input from band selecting section 701 in the past frame and the band information m_max input from band selecting section 701 in the current frame. Adaptive prediction determination section 703 determines that the prediction decoding is performed when the number of common sub-bands is equal to or more than the predetermined value, and adaptive prediction determination section 703 determines that the prediction decoding is not performed when the number of common sub-bands is less than the predetermined value. Specifically, adaptive prediction determination section 703 compares the L sub-bands that are indicated by the band information m_max input from band selecting section 701 in one frame before the current frame in the past frame and the L sub-bands that are indicated by the band information m_max input from band selecting section 701 in the current frame. Adaptive prediction determination section 703 determines that the predictive decoding is performed when the number of common sub-bands is equal to or more than P, and adaptive prediction determination section 703 determines that the predictive decoding is not performed when the number of common sub-bands is less than P. Adaptive prediction determination section 703 outputs the determination result to gain decoding section 704. Then, using the band information m_max input from band selecting section 301 in the current frame, adaptive prediction determination section 703 updates the built-in buffer in which the band information is stored.

Gain decoding section 704 is provided with a buffer in which the gain value obtained in the past frame is stored. When the determination result input from adaptive prediction determination section 703 indicates that the predictive decoding is performed, gain decoding section 704 predicts the gain value of the current frame to perform the dequantization using the gain value of the past frame stored inbuilt-in gain code book. Specifically, gain decoding section 704 is provided with the same gain code book as that of gain coding section 304 of second layer coding section 205, and gain decoding section 704 performs the dequantization to the gain to obtain a gain value Gain_q' according to the following equation (11). At this point, $C''^{t}_{j}$ indicates the gain of the frame in t frames before the current frame. For example, in the case of t=1, $C''^{t}_{j}$ indicates the gain of the frame in one frame before the current frame. $\alpha 0$ to $\alpha 3$ are quartic linear prediction coefficients stored in gain coding section 704. Gain decoding section 704 deals with the L sub-bands in one region as the L-dimensional vector to perform vector dequantization.

[11]

$$\text{Gain_q}'(j+j'') = \sum_{t=1}^{3}\left(\alpha_t \cdot C''^{t}_{j+j''}\right) + \alpha_0 \cdot GC_j^{G_min} \quad (j=0,\cdots,L-1) \qquad \text{(Equation 11)}$$

In the case that the gain of the sub-band corresponding to the past frame in the built-in buffer does not exist, in the equation (11), gain decoding section 704 substitutes the gain of the closest sub-band in terms of the frequency in the built-in buffer for the gain of the sub-band corresponding to the past frame in the built-in buffer.

On the other hand, when the determination result input from adaptive prediction determination section 703 indicates that the predictive decoding is not performed, gain decoding section 704 performs the dequantization to the gain value according to the following equation (12) using the gain code book. Gain decoding section 704 deals with the gain value as the L-dimensional vector to perform the vector dequantization. That is, in the case that the prediction decoding is not performed, a gain code vector $GC^{G_min}_{j}$ corresponding to the gain coded information G_min is directly used as the gain value.

[12]

$$\text{Gain_}q'(j+j'')=GC_j^{G_min}(j=0,\ldots,L-1) \qquad \text{(Equation 12)}$$

Then, gain decoding section 704 calculates the decoded MDCT coefficient as the second layer decoded spectrum according to the following equation (13) using the gain value obtained by the dequantization of the current frame and the value of the shape input from shape decoding section 702, and the gain decoding section 704 updates the built-in buffer according to the following equation (14). At this point, the calculated decoded MDCT coefficient is expressed by X2"(k). In the case that k exists in B(j") to B(j"+1)−1 during the dequantization of the decoded MDCT coefficient, the gain value Gain_q'(j) takes a value of Gain_q'(j").

[13]

$$X2''(k) = \text{Gain_q}'(j)\cdot\text{Shape_q}'(k)\begin{pmatrix} k = B(j''),\cdots,B(j''+L)-1 \\ j = j'',\cdots,j''+L-1 \end{pmatrix} \qquad \text{(Equation 13)}$$

[14]

$$\begin{cases} C''^{3}_{j} = C''^{2}_{j} \\ C''^{2}_{j} = C''^{1}_{j} \\ C''^{1}_{j} = GC_j^{G_min} \end{cases} \quad (j=j'',\cdots,j''+L-1) \qquad \text{(Equation 14)}$$

Gain decoding section 704 outputs the calculated second layer decoded spectrum X2"(k) to adder 207 and third layer coding section 208 according to the equation (13).

Figure 7:
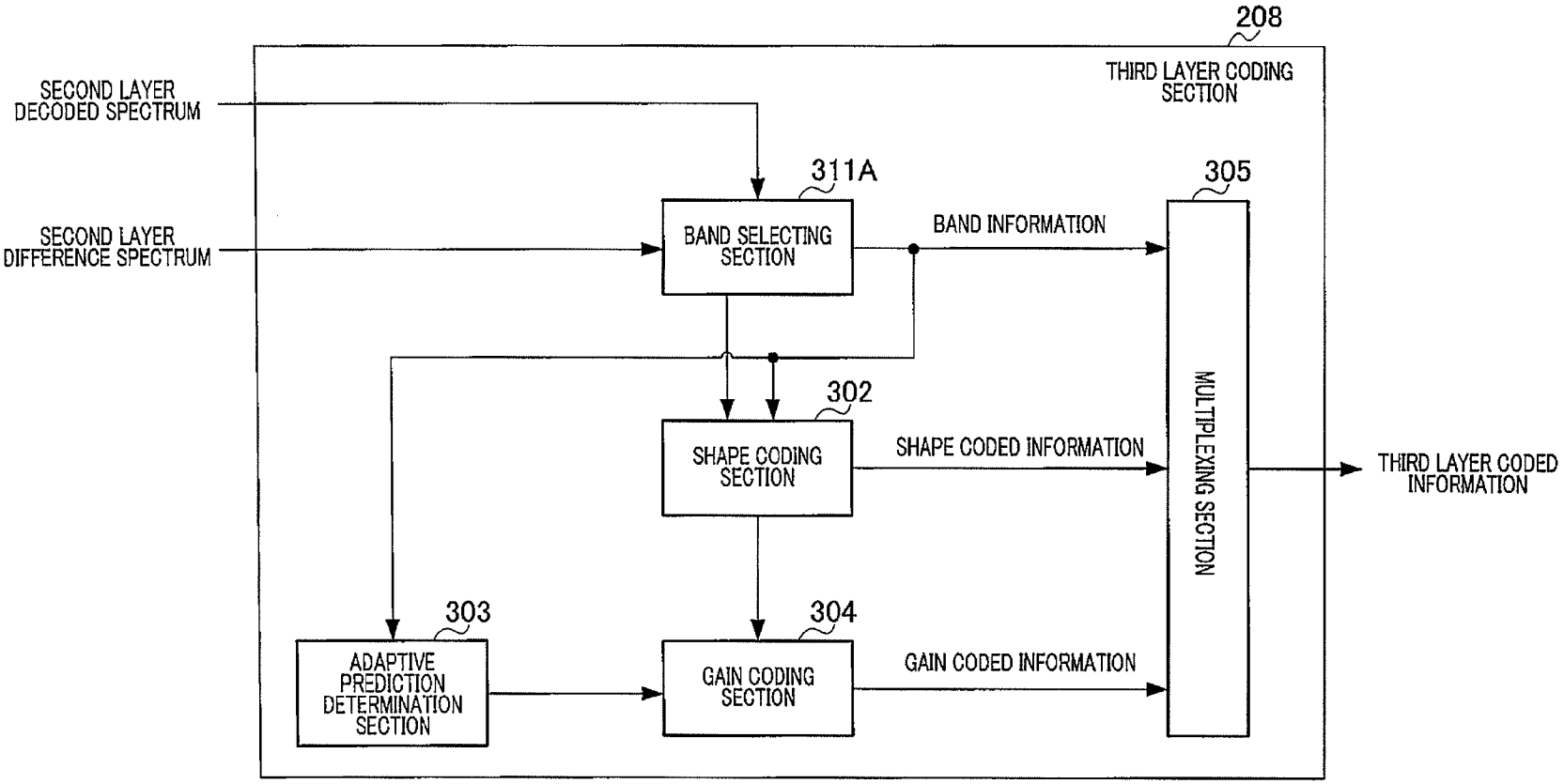
FIG. 7 is a block diagram illustrating a main configuration of a third layer coding section in FIG. 2.

FIG. 7 is a block diagram illustrating a main configuration of third layer coding section 208.

In FIG. 7, third layer coding section 208 includes band selecting section 311A, shape coding section 302, adaptive prediction determination section 303, gain coding section 304, and multiplexing section 305. Since the structural elements except band selecting section 311A constituting third layer coding section 208 are identical to those of second layer coding section 205, the structural elements are designated by the identical numeral, and the description thereof is omitted.

Figure 8:
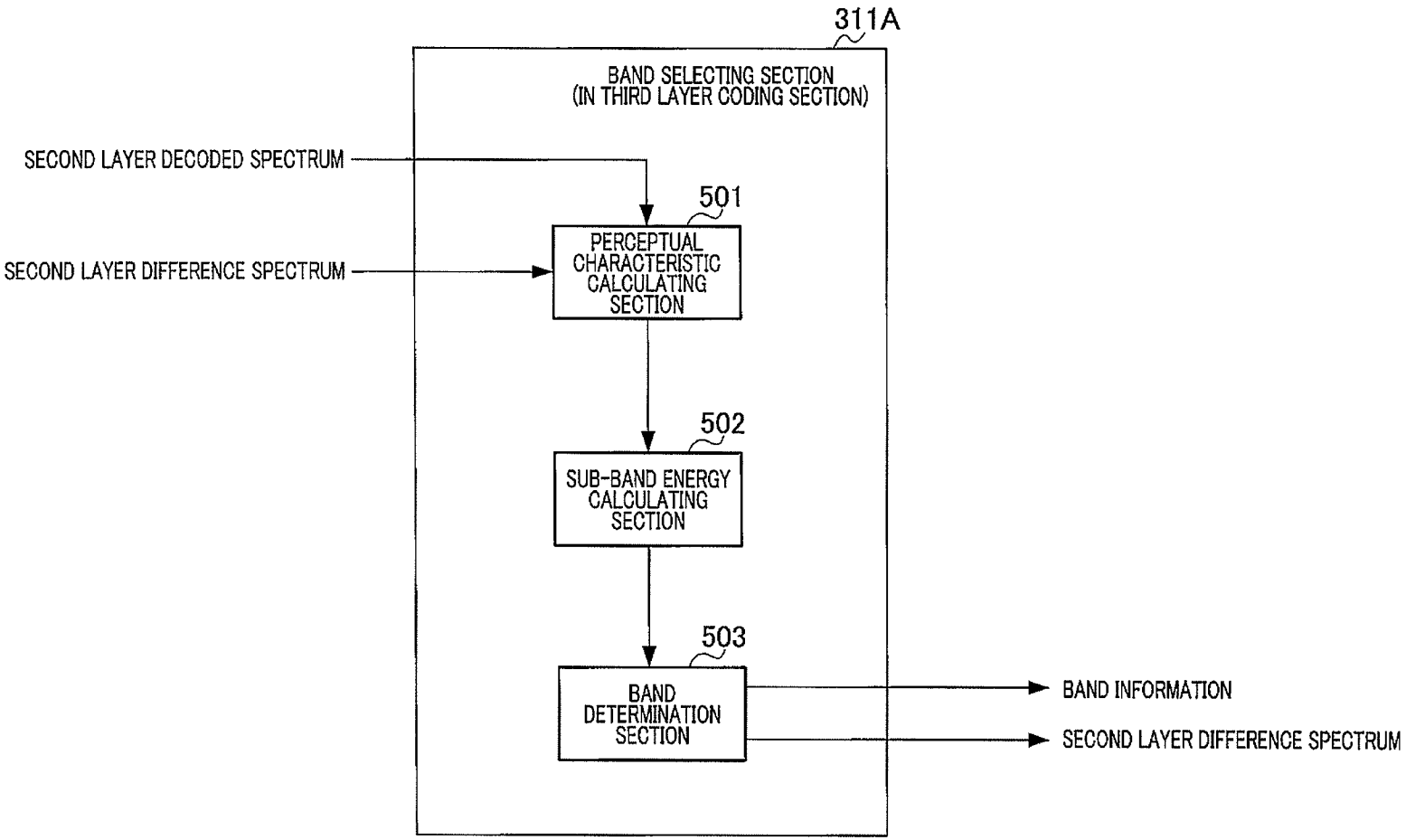
FIG. 8 is a block diagram illustrating a configuration of a band selecting section in FIG. 7.

FIG. 8 is a block diagram illustrating a configuration of band selecting section 311A.

In FIG. 8, band selecting section 311A mainly includes perceptual characteristic calculating section 501, sub-band energy calculating section 502, and band determination section 503.

The second layer difference spectrum X2(*k*) is input to perceptual characteristic calculating section 501 from adder 207. The second layer decoded spectrum X2"(k) is input to perceptual characteristic calculating section 501 from second layer decoding section 206.

Perceptual characteristic calculating section 501 calculates the index around a peak component of the spectrum encoded by second layer coding section 205 with respect to the second layer decoded spectrum X2"(k). This is the peak component quantized by shape coding section 302 of second layer coding section 205. Therefore, for example, in that case that shape coding section 302 encodes the spectrum by a sinusoidal coding method, the peak component can easily be calculated by decoding the shape coded information.

Perceptual characteristic calculating section 501 outputs the calculated index around the peak component and an amplitude value of the peak component to sub-band energy calculating section 502. At this point, the case that the spectrum component having the maximum amplitude in each sub-band is used as the peak component with respect to the second decoded spectrum X2"(k) will be described by way of example.

Similarly to sub-band energy calculating section 401, sub-band energy calculating section 502 divides the second layer difference spectrum X2(*k*) into the plural sub-bands. The second layer difference spectrum input to band selecting section 311A may directly be input to sub-band energy calculating section 502, or the second layer difference spectrum may be input through perceptual characteristic calculating section 501. The case that the second layer difference spectrum X2(*k*)

is equally divided into J (J is a natural number) sub-bands will be described by way of example. Sub-band energy calculating section 502 selects the consecutive L (L is a natural number) sub-bands in the J sub-bands to obtain the M (M is a natural number) kinds of groups of the sub-bands. As described above, hereinafter the M kinds of groups of the sub-bands are referred to as the region.

Then, sub-band energy calculating section 502 calculates average energy E2(*m*) of each of the M kinds of regions according to the following equation (15-1) using the information on the index around the peak component input from perceptual characteristic calculating section 501 and the information on the amplitude value of the peak component. At this point, it is assumed that temporary spectrum X(k) in the equation (15-1) is expressed by an equation (15-2).

[15]

$$E2(m) = \frac{\sum_{j=S(m)}^{S(m)+L-1} \sum_{k=B(j)}^{B(j)+W(j)} (X(k))^2}{L} \quad (m = 0, \cdots, M-1) \qquad \text{(Equation 15-1)}$$

$$X(k) = \begin{cases} X2(k) & \text{if } (k < Peak_{start}) \text{ or } (k > Peak_{end}) \\ X2(k) - \beta \cdot PeakValue & \text{else} \end{cases} \qquad \text{(Equation 15-2)}$$

Where j is the index of each of the J sub-bands and m is the index of each of the M kinds of regions. S(m) indicates the minimum value in the indexes of the L sub-bands constituting region m, and B(j) is the minimum value in the indexes of the plural MDCT coefficients constituting sub-band j. W(j) indicates the band width of sub-band j. The case that J sub-bands have the equal band width, namely, W(j) is a constant will be described below by way of example.

As expressed by an equation (15-2), in the case that an index k does not correspond to the index around the peak component input from perceptual characteristic calculating section 501, the value of a temporary spectrum X(k) is directly used to calculate the average energy E2(*m*) of each region.

On the other hand, in the case that the index k corresponds to the index around the peak component input from perceptual characteristic calculating section 501, namely, in the case that the index k exists in a start index $Peak_{start}$ to an end index $Peak_{end}$ around the peak component, sub-band energy calculating section 502 subtracts a value, in which a predetermined value β is multiplied by the amplitude value PeakValue of the peak component input from perceptual characteristic calculating section 501, from the value of the second layer difference spectrum X2(*k*). Sub-band energy calculating section 502 calculates the average energy E2(*m*) of each region using the temporary spectrum X(k) after the subtraction.

Thus, sub-band energy calculating section 502 undervalues the energy of the spectrum component existing around the large component (peak component) in the spectrum components encoded in the lower layer. As a result, another perceptually important spectrum component can easily be selected to generate the perceptually better decoded signal.

At this point, in the case that a sign of the temporary spectrum X(k) is changed by the subtraction processing, the value of the temporary spectrum X(k) is set to 0. β is a coefficient of 0 to 1 that is multiplied by the amplitude value of the peak component of the spectrum that is already quantized in the lower layer. A value of about 0.5 can be cited as an example of the coefficient β.

A perception masking effect becomes stronger with decreasing distance on a frequency axis from a masker (that is a component on a masked side, and indicates the peak component in this case). At this point, a method of calculating the value of X(k) using the constant β will be described for the purpose of not largely increasing a calculation amount. Similarly, the invention is also applied in the case that the correct perception masking characteristic value is calculated.

Sub-band energy calculating section 502 outputs the obtained average energy E2(*m*) of each region to band determination section 503.

The average energy E2(*m*) of each region is input to band determination section 503 from sub-band energy calculating section 502. Band determination section 503 selects the region where the average energy E2(*m*) is maximized, for example, the band including sub-bands j" to (j"+L−1) as the band (quantization target band) that becomes the quantization target, and band determination section 503 outputs an index m_max indicating the region as the band information to shape coding section 302, adaptive prediction determination section 303, and multiplexing section 305.

As described above, in the case that the index k corresponds to the index around the peak component input from perceptual characteristic calculating section 501, namely, in the case that the index k exists from the start index $Peak_{start}$ to the end index $Peak_{end}$ around the peak component, sub-band energy calculating section 502 performs the perception masking by subtracting a value, in which the predetermined value β is multiplied by the amplitude value PeakValue of the peak component input from perceptual characteristic calculating section 501, from the value of X2(*k*).

In consideration of the perception masking effect, sub-band energy calculating section 502 calculates the average energy E2(*m*) of each region using the value of X(k) after the subtraction, thereby undervaluing the energy of the spectrum component existing around the large component (peak component) in the spectrum components encoded in the lower layer. Therefore, another perceptually important spectrum component can easily be selected in band determination section 503. Therefore, the perceptually better decoded signal can be generated.

Band determination section 503 outputs the second layer difference spectrum X2(*k*) of the quantization target band to shape coding section 302. The second layer difference spectrum input to band selecting section 311A may directly be input to band determination section 503, or the second layer difference spectrum may be input through perceptual characteristic calculating section 501 and/or sub-band energy calculating section 502. Hereinafter, it is assumed that j" to (j"+L−1) are band indexes indicating the quantization target band selected by band determination section 503.

The processing of third layer coding section 208 has been described above.

The processing of third layer decoding section 209 is identical to that of second layer decoding section 206 except that the third layer coded information and the third layer decoded spectrum are input and output instead of the second layer coded information and the second layer decoded spectrum, respectively. Therefore, the description is omitted.

The processing of fourth layer coding section 211 is identical to that of third layer coding section 208 except that the third layer difference spectrum, the third layer decoded spectrum and the fourth layer coded information are input and output instead of the second layer difference spectrum, the second layer decoded spectrum, and the third layer coded information, respectively. Therefore, the description is omitted.

The processing of coding apparatus 101 has been described above.

Figure 9:
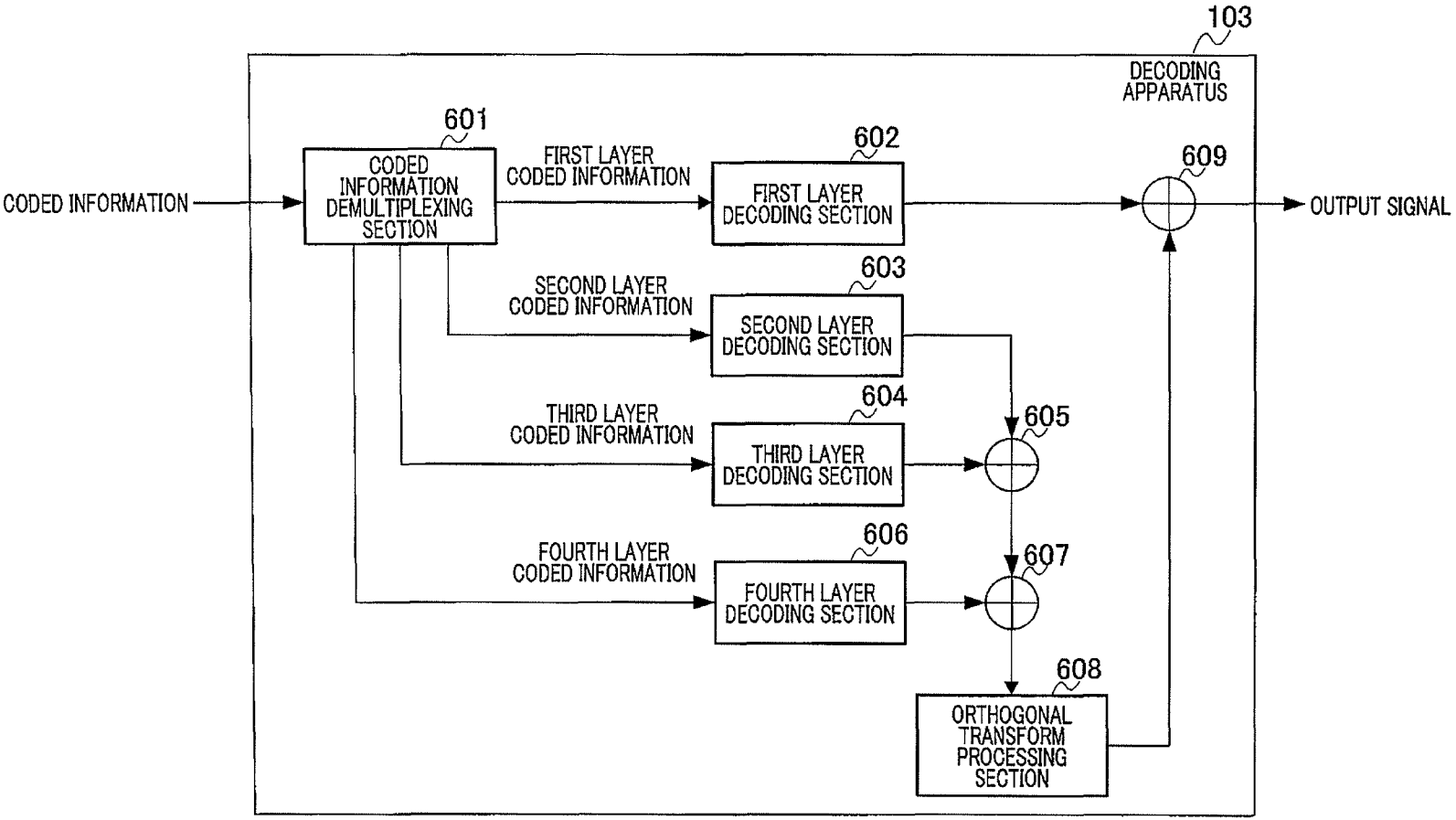
FIG. 9 is a block diagram illustrating a main configuration of the decoding apparatus in FIG. 1.

FIG. 9 is a block diagram illustrating a main configuration of decoding apparatus 103 in FIG. 1. For example, it is assumed that decoding apparatus 103 is a hierarchical decoding apparatus including four decoding hierarchies (layers). At this point, similarly to coding apparatus 101, it is assumed that the four layers are called as a first layer, a second layer, a third layer, and a fourth layer in the ascending order of the bit rate.

The coded information transmitted from coding apparatus 101 through transmission line 102 is input to coded information demultiplexing section 601, and coded information demultiplexing section 601 demultiplexes the coded information into the pieces of coded information of the layers to output each piece of coded information to the decoding section that performs the decoding processing of each piece of coded information. Specifically, coded information demultiplexing section 601 outputs the first layer coded information included in the coded information to first layer decoding section 602, outputs the second layer coded information included in the coded information to second layer decoding section 603, outputs the third layer coded information included in the coded information to third layer decoding section 604, and outputs the fourth layer coded information included in the coded information to fourth layer decoding section 606.

First layer decoding section 602 decodes the first layer coded information, which is input from coded information demultiplexing section 601, by the CELP speech decoding method to generate the first layer decoded signal, and outputs the generated first layer decoded signal to adder 609.

Second layer decoding section 603 decodes the second layer coded information input from coded information demultiplexing section 601, and outputs the obtained second layer decoded spectrum X2"(k) to adder 605. Since the processing of second layer decoding section 603 is identical to that of second layer decoding section 206, the description is omitted.

Third layer decoding section 604 decodes the third layer coded information input from coded information demultiplexing section 601, and outputs the obtained third layer decoded spectrum X3"(k) to adder 605. Since the processing of third layer decoding section 604 is identical to that of third layer decoding section 209, the description is omitted.

The second layer decoded spectrum X2"(k) is input to adder 605 from second layer decoding section 603. The third layer decoded spectrum X3"(k) is input to adder 605 from third layer decoding section 604. Adder 605 adds the input second layer decoded spectrum X2"(k) and third layer decoded spectrum X3"(k), and outputs the added spectrum as a first addition spectrum X5"(k) to adder 607.

Fourth layer decoding section 606 decodes the fourth layer coded information input from coded information demultiplexing section 601, and outputs the obtained fourth layer decoded spectrum X4"(k) to adder 607. Since the processing of fourth layer decoding section 606 is identical to that of third layer decoding section 209 except input and output names, the description is omitted.

A first addition spectrum X5"(k) is input to adder 607 from adder 605. The fourth layer decoded spectrum X4"(k) is input to adder 607 from fourth layer decoding section 606. Adder 607 adds the input first addition spectrum X5"(k) and fourth layer decoded spectrum X4"(k), and outputs the added spectrum as a second addition spectrum X6"(k) to orthogonal transform processing section 608.

Orthogonal transform processing section 608 initializes built-in buffer buf'(k) to an initial value "0" by the following equation (16).

[16]

$$buf'(k)=0(k=0,\ldots,N-1) \quad \text{(Equation 16)}$$

The second addition spectrum X6"(k) is input to orthogonal transform processing section 608, and orthogonal transform processing section 608 obtains a second addition decoded signal y"(n) according to the following equation (17).

[17]

$$y''(n)=\frac{2}{N}\sum_{n=0}^{2N-1}X7(k)\cos\left[\frac{(2n+1+N)(2k+1)\pi}{4N}\right] \quad \text{(Equation 17)}$$

$$(n=0,\cdots,N-1)$$

In the equation (17), X7(*k*) is a vector in which the second addition spectrum X6"(k) and buffer buf'(k) are coupled, and X7(*k*) is obtained using the following equation (18).

[18]

$$X7(k)=\begin{cases} buf'(k) & (k=0,\cdots N-1) \\ X6''(k) & (k=N,\cdots 2N-1) \end{cases} \quad \text{(Equation 18)}$$

Then, orthogonal transform processing section 608 updates buffer buf'(k) according to the following equation (19).

[19]

$$buf'(k)=X''6(k)(k=0,\ldots,N-1) \quad \text{(Equation 19)}$$

Orthogonal transform processing section 608 outputs the second addition decoded signal y"(n) to adder 609.

The first layer decoded signal is input to adder 609 from first layer decoding section 602. The second addition decoded signal is input to adder 609 from orthogonal transform processing section 608. Adder 609 adds the input first layer decoded signal and second addition decoded signal, and outputs the added signal as the output signal.

The processing of decoding apparatus 103 has been described above.

According to Embodiment 1, in the configuration of coding apparatus 101 that performs the hierarchy encoding (scalable) to select the band (quantization target band) that becomes the quantization target in each hierarchy (layer), band selecting section 311A selects the quantization target band of the current layer based on the coding result (quantized band information) of the lower layer. Specifically, in band selecting section 311A, perceptual characteristic calculating section 501 searches the spectrum component (peak component) having the maximum amplitude in each sub-band with respect to the spectrum component quantized in the lower layer. In the case that the index k exists from the start index $Peak_{start}$ to the end index $Peak_{end}$ around the peak component, sub-band energy calculating section 502 subtracts the value, in which the predetermined value β is multiplied by the amplitude value PeakValue of the peak component input from perceptual characteristic calculating section 501, from the value of the second layer difference spectrum X2(*k*). Sub-band energy calculating section 502 calculates the average energy E2(*m*) of each region using the temporary spectrum X(k) after the subtraction. Band determination section 503 selects the region where the average energy E2(*m*) is maximized, for example, the band including sub-bands j" to (j"+L−1) as the band (quantization target band) that becomes the quantization target. Therefore, in the current layer, the perceptually important band is encoded in consideration of the perception masking effect of the spectrum encoded in the lower layer, so that the quality of the decoded signal can be improved.

In Embodiment 1, perceptual characteristic calculating section 501 searches the spectrum component (peak component) having the maximum amplitude in each sub-band with respect to the spectrum component quantized in the lower layer, and sub-band energy calculating section 502 calculates the average energy of the region in consideration of the perception masking effect for the peak component. However, the invention is not limited to Embodiment 1. The invention can similarly be applied to the case that perceptual characteristic calculating section 501 searches the plural peak components. In this case, it is necessary that sub-band energy calculating section 502 calculates the average energy of the region in consideration of the perception masking effect for each of the plural peak components.

Embodiment 2

Embodiment 2 of the invention will describe a configuration in which the calculation amount is further reduced without adopting the band selecting method of Embodiment 1 in gain coding sections 304 of third layer coding section 208 and fourth layer coding section 211.

A communication system (not illustrated) according to Embodiment 2 is basically identical to the communication system in FIG. 1, and a coding apparatus of the communication system of Embodiment 2 differs from coding apparatus 101 of the communication system in FIG. 1 only in parts of the configuration and operation. The description is made while the coding apparatus of the communication system of Embodiment 2 is designated by the numeral "111". Specifically, Embodiment 2 differs from Embodiment 1 only in the operations of the band selecting sections in the third layer coding section 208 and fourth layer coding section 211. The description is made while the band selecting sections in the third layer coding section 208 and fourth layer coding section 211 of Embodiment 2 are designated by the numeral "321". Since decoding apparatus 103 is identical to that of Embodiment 1, the description is omitted.

A schematic diagram of coding apparatus 111 of Embodiment 2 is identical to that in FIG. 2, and the second layer decoded spectrum and the third layer decoded spectrum are input to third layer coding section 208 and fourth layer coding section 211 of Embodiment 2 from second layer decoding section 206 and third layer decoding section 209, respectively.

In band selecting sections 321 in third layer coding section 208 and fourth layer coding section 211 of Embodiment 2, the second layer coded information and the third layer coded information may be input instead of the second layer decoded spectrum and the third layer decoded spectrum, respectively. This is because the band information quantized in the lower layer is utilized in band selecting section 321.

Accordingly, not the configuration in which the second layer decoded spectrum and the third layer decoded spectrum are input to third layer coding section 208 and fourth layer coding section 211 from second layer decoding section 206 and third layer decoding section 209, respectively, but the configuration in which the second layer coded information and the third layer coded information are input from second layer coding section 205 and third layer coding section 208, respectively will be described below.

Figure 10:
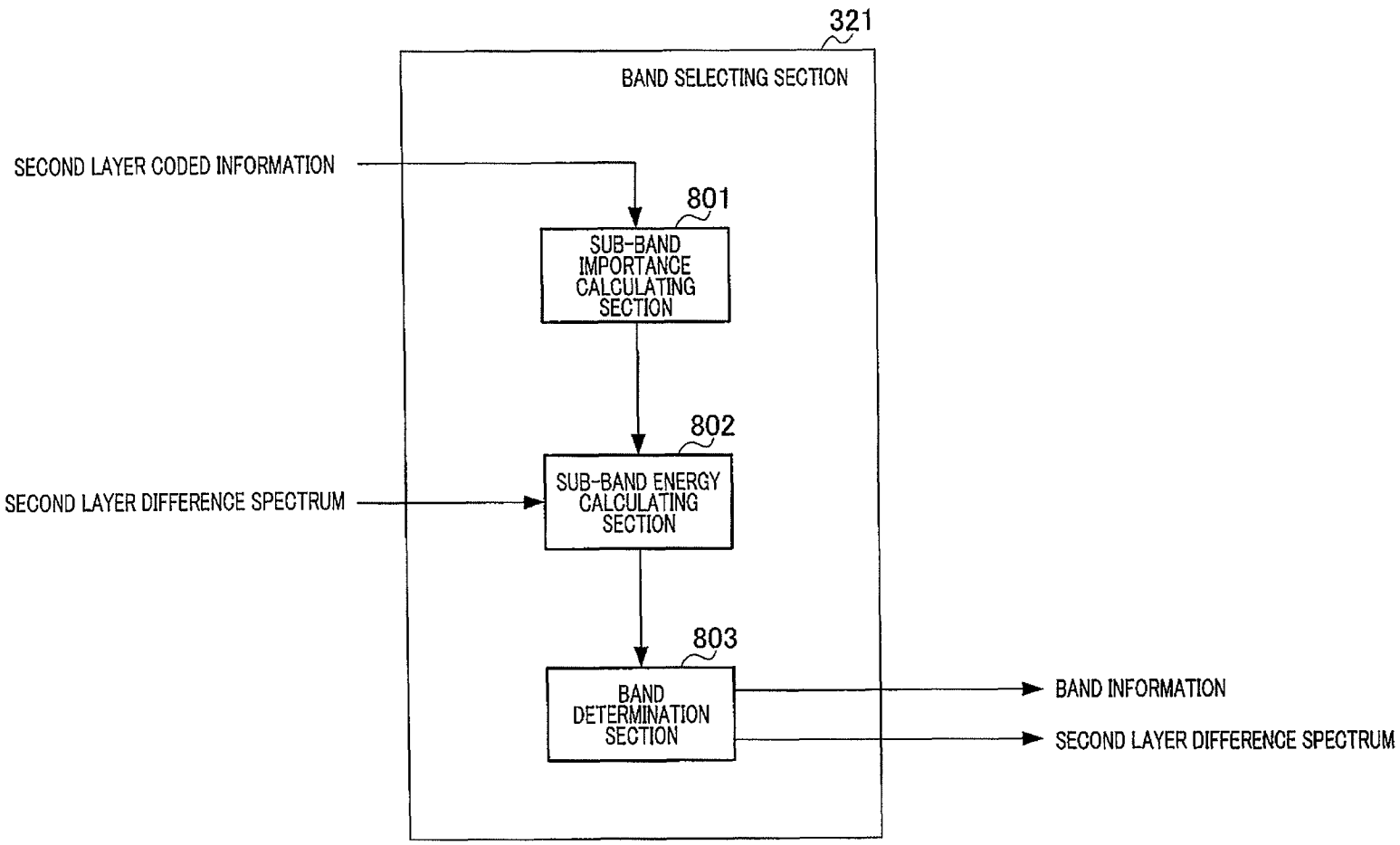
FIG. 10 is a block diagram illustrating a main configuration of a band selecting section of a third layer coding section according to Embodiment 2 of the invention.

FIG. 10 is a block diagram illustrating a main configuration of band selecting section 321. Band selecting section 321 is a processing block common to both third layer coding section 208 and fourth layer coding section 211. The processing of band selecting section 321 in third layer coding section 208 will representatively be described below.

In FIG. 10, band selecting section 321 mainly includes sub-band importance calculating section 801, sub-band energy calculating section 802, and band determination section 803.

The second layer coded information is input to sub-band importance calculating section 801 from second layer coding section 205.

Sub-band importance calculating section 801 includes a buffer that retains a degree of importance imp(k) (k=0 to N−1) for the perception in each sub-band of the second layer difference spectrum. At this point, for example, an initial value of the degree of importance is set to 1.0.

Sub-band importance calculating section 801 undervalues the importance value with respect to the sub-band that is indicated by the band information included in the input second layer coded information, namely, the band that is selected as the quantization target and quantized in second layer coding section 205 of the lower layer.

Specifically, sub-band importance calculating section 801 multiplies a predetermined coefficient γ by the degree of importance of the sub-band that is indicated by the band information included in the second layer coded information according to an equation (20). At this point, the degree of importance that is multiplied by γ is expressed by imp2(*k*).

[20]

$$imp2(k)=imp(k)\cdot\gamma(k=0,\ldots N-1) \quad \text{(Equation 20)}$$

Desirably the value of γ is equal to or more than 0 and less than 1. For example, in the case of γ=0.8, the experimental result shows that the good effect is exerted. The value of γ may be set to a value except 0.8.

The processing of adjusting the importance value of the sub-band using the equation (20) can also be applied to fourth layer coding section 211. That is, the sub-band that is quantized by both second layer coding section 205 and third layer coding section 208 is multiplied by γ twice. The number of γ multiplying times depends on the number of layers constituting coding apparatus 111. Therefore, the invention can similarly be applied to the case that γ is multiplied the number of times except the above number of times.

Sub-band importance calculating section 801 outputs the degree of importance imp2(*k*) (k=0 to N−1) of each sub-band to sub-band energy calculating section 802. Sub-band importance calculating section 801 updates the internal buffer according to an equation (21) using the degree of importance imp2($k$) (k=0 to N−1) of each sub-band.

[21]

$$imp(k)=imp2(k)(k=0, \ldots N-1) \quad \text{(Equation 21)}$$

The degree of importance imp2($k$) (k=0 to N−1) of each sub-band is input to sub-band energy calculating section 802 from sub-band importance calculating section 801. The second layer difference spectrum is input to sub-band energy calculating section 802 from adder 207.

Sub-band energy calculating section 802 divides the second layer difference spectrum X2($k$) into the plural sub-bands. The case that second layer difference spectrum X2($k$) is equally divided into the J (J is a natural number) sub-bands will be described by way of example. Sub-band energy calculating section 802 selects the consecutive L (L is a natural number) sub-bands in the J sub-bands to obtain the M (M is a natural number) kinds of groups of the sub-bands. Similarly to Embodiment 1, hereinafter the M kinds of groups of the sub-bands are referred to as the region. Since the configuration of the region is identical to that of Embodiment 1, the description thereof is omitted.

Then, sub-band energy calculating section 802 calculates average energy E3($m$) of each of the M kinds of regions according to the following equation (22).

[22]

$$E3(m) = \frac{\sum_{j=S(m)}^{S(m)+L-1} \left[ \left( \sum_{k=B(j)}^{B(j)+W(j)} (X(k))^2 \right) \cdot imp2(k) \right]}{L} \quad \text{(Equation 22)}$$

$$(m = 0, \cdots, M-1)$$

Where j is the index of each of the J sub-bands and m is the index of each of the M kinds of regions. S(m) indicates the minimum value in the indexes of the L sub-bands constituting region m, and B(j) is the minimum value in the indexes of the plural MDCT coefficients constituting sub-band j. W(j) indicates the band width of sub-band j. The case will be described below by way of example that J sub-bands have the equal band width, namely, W(j) is a constant.

As can be seen from equation (21), in Embodiment 2, sub-band energy calculating section 802 multiplies the degree of importance of each sub-band by the energy of each sub-band, and totalizes energy of each sub-band after the degree of importance is multiplied, thereby calculating the average energy of each region. This point differs from the method of calculating the average energy of each region of Embodiment 1.

As described above, the degree of importance of the sub-band quantized by the second layer coding section 205 of the lower layer is multiplied by γ having the value equal to or more than 0 and less than 1, and the degree of importance is corrected lower. Therefore, the energy of the sub-band that is not selected as the quantization target is undervalued by the equation (21). Thus, the region including the sub-band that is already quantized in the lower layer is hardly selected by utilizing the degree of importance of each sub-band as the average energy of the region.

Sub-band energy calculating section 802 outputs the obtained average energy E3($m$) of each region to band determination section 803.

The average energy E3($m$) of each region is input to band determination section 803 from sub-band energy calculating section 802. Band determination section 803 selects the region where the average energy E3($m$) is maximized, for example, the band including sub-bands j" to (j"+L−1) as the band (quantization target band) that becomes the quantization target, and band determination section 803 outputs the index m_max indicating the region as the band information to shape coding section 302, adaptive prediction determination section 303, and multiplexing section 305.

Band determination section 803 also outputs the second layer difference spectrum X2($k$) of the quantization target band to shape coding section 302. The second layer difference spectrum input to band selecting section 321 may directly be input to band determination section 803, or the second layer difference spectrum may be input through sub-band energy calculating section 802. Hereinafter, it is assumed that j" to (j"+L−1) are band indexes indicating the quantization target band selected by band determination section 803.

The processing of each of band selecting sections 321 in third layer coding section 208 and fourth layer coding section 211 has been described above.

According to Embodiment 2, upon calculating the energy of each sub-band, band selecting section 321 in each of third layer coding section 208 and fourth layer coding section 211 sets (corrects) the degree of importance based on whether the sub-band is already quantized in the lower layer, and band selecting section 321 utilizes the degree of importance after the setting (correction).

Specifically, the degree of importance of the sub-band that is already quantized in the lower layer is set (corrected) lower, and the energy is calculated in consideration of the degree of importance after the setting (correction). Therefore, since the energy is undervalued compared with the sub-band that is not quantized in the lower layer, the sub-band that is quantized in the lower layer is hardly selected as the quantization target in the current layer. As a result, the band that is selected as the quantization target and quantized can be prevented from being partially biased over the plural layers. The wider band is quantized in all the layers, so that the improvement of the quality of the decoded signal can be achieved (for example, the wider band can perceptually be sensed).

In Embodiment 1, the perception masking effect is calculated in each peak of the spectrum quantized in the lower layer. On the other hand, in Embodiment 2, it is only necessary to set (correct) the perceptual degree of importance in each sub-band. Therefore, the quantization band is selected in the higher layer based on the quantization result in the lower layer, which allows the processing calculation amount to be largely reduced compared with Embodiment 1 in implementing the quality of the decoded signal.

Embodiments 1 and 2 of the invention have been described above.

In Embodiments 1 and 2, the coding apparatus is configured to include the four encoding hierarchies (layers). The invention is not limited to the four encoding hierarchies, but the invention can also be applied to the configuration except the four encoding hierarchies.

In Embodiments 1 and 2, the CELP encoding/decoding method is adopted in the lowest first layer coding section/decoding section. The invention is not limited to Embodiments 1 and 2, but the invention can also be applied to the case that the layer in which the CELP encoding/decoding method is adopted does not exist. For example, the adder that performs the addition and subtraction on the temporal axis in the coding apparatus and the decoding apparatus is eliminated for the configuration including the layers in each of which the frequency transform encoding/decoding method is adopted.

In Embodiments 1 and 2, the coding apparatus calculates the difference signal between the first layer decoded signal and the input signal, and performs the orthogonal transform processing to calculate the difference spectrum. However, the invention is not limited to Embodiments 1 and 2. Alternatively, the present invention can also be applied to the configuration that after the orthogonal transform processing may be performed to the input signal and the first layer decoded signal to calculate the input spectrum and the first layer decoded spectrum, the difference spectrum may be calculated.

In Embodiments 1 and 2, the coding apparatus calculates the average energy of the region in each coding layer to select the band of the quantization target. However, the invention is not limited to Embodiments 1 and 2. Alternatively, the present invention can also be applied to the method that the average energy of each region may be calculated by subtracting the energy calculated from the shape coded information and the gain coded information, which are encoded in the lower layer, from the average energy of the region that is already calculated in the lower layer.

In Embodiments 1 and 2, by way of example, the third layer coding section selects the quantization target band by utilizing the coding result of the lower layer (second layer coding section). Alternatively, the invention can also be applied to the band selecting section of the second layer coding section. In this case, the quantization target band is selected by utilizing the coding result of the first layer coding section. For example, the quantization target band may be selected by utilizing a pitch cycle (pitch frequency) and a pitch gain, which are calculated by the first layer coding section. Specifically, the energy of the sub-band is evaluated, after a weight is multiplied such that the sub-band including the pitch frequency and the band corresponding to a multiple of the pitch frequency is easily selected.

Particularly, the sinusoid encoding method is effectively adopted as the shape coding method because the energy of the quantized shape is easily calculated.

The coding apparatus, decoding apparatus, and methods thereof are not limited to Embodiments 1 and 2, but various changes can be made. For example, Embodiments 1 and 2 can be implemented by a proper combination.

In Embodiments 1 and 2, the decoding apparatus performs the processing using the coded information transmitted from the coding apparatus of Embodiments 1 and 2. Alternatively, as long as the coded information includes the necessary parameter and data, the processing can be performed with no use of the coded information transmitted from the coding apparatus of Embodiments 1 and 2.

In addition, the present invention is also applicable to cases where this signal processing program is recorded and written on a machine-readable recording medium such as memory, disk, tape, CD, or DVD, achieving behavior and effects similar to those of the present embodiment.

Also, although cases have been described with Embodiments 1 and 2 as examples where the present invention is configured by hardware, the present invention can also be realized by software.

Each function block employed in the description of each of Embodiments 1 and 2 may typically be implemented as an LSI constituted by an integrated circuit. These may be implemented individually as single chips, or a single chip may incorporate some or all of them. Here, the term LSI has been used, but the terms IC, system LSI, super LSI, and ultra LSI may also be used according to differences in the degree of integration.

Further, the method of circuit integration is not limited to LSI, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI as a result of the advancement of semiconductor technology or a derivative other technology, it is naturally also possible to carry out function block integration using this technology. Application of biotechnology is also possible.

The present invention contains the disclosures of the specification, the drawings, and the abstract of Japanese Patent Application No. 2009-237683 filed on Oct. 14, 2009, the entire contents of which being incorporated herein by reference.

INDUSTRIAL APPLICABILITY

The coding apparatus, decoding apparatus, and methods thereof according to the present invention can improve the quality of the decoded signal in the configuration in which the quantization target band is selected in the hierarchical manner to perform the coding/decoding. For example, the coding apparatus, decoding apparatus, and methods thereof according to the present invention can be applied to the packet communication system and the mobile communication system.

REFERENCE SIGNS LIST

101 Coding apparatus
103 Decoding apparatus
102 Transmission line
201 First layer coding section
202, 602 First layer decoding section
203, 207, 210, 605, 607, 609 Adder
204, 608 Orthogonal transform processing section
205 Second layer coding section
206, 603 Second layer decoding section
208 Third layer coding section
209, 604 Third layer decoding section
211 Fourth layer coding section
212 Coded information integration section
301, 311A, 321 Band selecting section
302 Shape coding section
303 Adaptive prediction determination section
304 Gain coding section
305 Multiplexing section
401, 502, 802 Sub-band energy calculating section
402, 503, 803 Band determination section
701 Demultiplexing section
702 Shape decoding section
703 Adaptive prediction determination section
704 Gain decoding section
501 Perceptual characteristic calculating section
601 Coded information demultiplexing section
606 Fourth layer decoding section
801 Sub-band importance calculating section

The invention claimed is:

1. A coding apparatus that includes at least two coding layers, the coding apparatus comprising a circuit, the circuit comprising:

a first layer coding section that receives a first speech input signal of a frequency domain, selects a first quantization target band of the first speech input signal from a plurality of sub-bands into which the frequency domain is divided, encodes the first speech input signal of the first quantization target band to generate first coded information including first band information on the first quantization target band, generates a first decoded signal using the first coded information, and generates a second speech input signal using the first speech input signal and the first decoded signal; and a second layer coding section that receives the second speech input signal and the first decoded signal or the first coded information, selects a second quantization target band of the second speech input signal from the plurality of sub-bands using the first decoded signal or the first coded information, encodes the second speech input signal of the second quantization target band, and generates second coded information including second band information on the second quantization target band, wherein the second layer coding section selects the second quantization target band by relatively undervaluing weighting related to a degree of importance to the first quantization target band with respect to a first quantization target band included in the first coded information and a band except the first quantization target band.

2. A communication terminal apparatus comprising the coding apparatus according to claim 1.

3. A base station apparatus comprising the coding apparatus according to claim 1.

4. A coding method of performing encoding in at least two coding layers, comprising:

in a first layer of encoding:

receiving a first speech input signal of a frequency domain, selecting a first quantization target band of the first speech input signal from a plurality of sub-bands into which the frequency domain is divided, encoding the first speech input signal of the first quantization target band to generate first coded information including first band information on the first quantization target band, generating a first decoded signal using the first coded information, and generating a second speech input signal using the first speech input signal and the first decoded signal; and in a second layer of encoding:

receiving the second speech input signal and the first decoded signal or the first coded information, selecting a second quantization target band of the second speech input signal from the plurality of sub-bands using the first decoded signal or the first coded information, encoding the second speech input signal of the second quantization target band, and generating second coded information including second band information on the second quantization target band, wherein in the second layer encoding, selecting the second quantization target band by relatively undervaluing weighting related to a degree of importance to the first quantization target band with respect to a first quantization target band included in the first coded information and a band except the first quantization target band.

5. A coding apparatus that includes at least two coding layers, the coding apparatus comprising a processor, the processor comprising:

a first layer coding section that receives a first speech input signal of a frequency domain, selects a first quantization target band of the first speech input signal from a plurality of sub-bands into which the frequency domain is divided, encodes the first speech input signal of the first quantization target band to generate first coded information including first band information on the first quantization target band, generates a first decoded signal using the first coded information, and generates a second speech input signal using the first speech input signal and the first decoded signal; and a second layer coding section that receives the second speech input signal and the first decoded signal or the first coded information, selects a second quantization target band of the second speech input signal from the plurality of sub-bands using the first decoded signal or the first coded information, encodes the second speech input signal of the second quantization target band, and generates second coded information including second band information on the second quantization target band, wherein the second layer coding section selects the second quantization target band by relatively undervaluing weighting related to a degree of importance to the first quantization target band with respect to a first quantization target band included in the first coded information and a band except the first quantization target band.

* * * * *